US005357777A

United States Patent [19]

Castellano

[11] Patent Number: 5,357,777

[45] Date of Patent: Oct. 25, 1994

[54] POSITIONING APPARATUS FOR A FRAME RACK FOR INSPECTION AND ALIGNMENT OF AUTOMOTIVE VEHICLE UNIBODIES AND FRAMES

[76] Inventor: Sam Castellano, 6202 36th Ave. South, Tampa, Fla. 33619

[21] Appl. No.: 68,929

[22] Filed: May 28, 1993

[51] Int. Cl.[5] ..... B21D 1/12

[52] U.S. Cl. ..... 72/305; 72/705; 33/608

[58] Field of Search ..... 33/600, 608; 72/305, 72/705; 187/8.41, 8.52, 8.67

[56] References Cited

U.S. PATENT DOCUMENTS

| | | | |
|---|---|---|---|
| 1,675,015 | 6/1928 | Aldinger . | |
| 3,257,838 | 6/1966 | Spears | 72/705 |
| 3,405,781 | 10/1968 | Brown | 187/8.41 |
| 4,463,937 | 8/1984 | Celette | 269/17 |
| 4,603,570 | 8/1986 | Dehn | 72/705 |
| 4,916,933 | 4/1990 | Celette | 72/457 |
| 5,027,639 | 7/1991 | Hinson | 72/705 |
| 5,054,207 | 10/1991 | Marshall | 33/608 |

*Primary Examiner*—Lowell A. Larson
*Attorney, Agent, or Firm*—Pettis & McDonald

[57] ABSTRACT

An apparatus to be used in combination with an automotive vehicle and a frame rack, of the type having two substantially parallel and spaced apart longitudinal members, which is used for correcting the frame alignment of damaged vehicles. The apparatus comprises four carriages, with at least two carriages being mounted for independent movement on each member. Each carriage comprises a chassis with a dolly mounted thereon for movement transverse to the longitudinal movement of the carriage. Each dolly is capable of supporting one automotive support point even when the support points are out of alignment, permitting easy movement of the automotive vehicle on the frame rack and easy movement of the support points during repairs, and providing a means for determining the relationship of each automotive support point relative to one another.

12 Claims, 3 Drawing Sheets

POSITIONING APPARATUS FOR A FRAME RACK FOR INSPECTION AND ALIGNMENT OF AUTOMOTIVE VEHICLE UNIBODIES AND FRAMES

BACKGROUND OF THE INVENTION

1. Field of the Invention

The present invention relates to an apparatus to be used in combination with an automotive vehicle and a frame rack for correcting the frame alignment of damaged vehicles. The apparatus comprises a plurality of carriages adapted for independent movement on a frame rack. Each carriage, being independently movable, is capable of supporting one automotive support point even when the support points are out of alignment, and permits easy movement of the automotive vehicle while bringing its center line in alignment with the center line of the frame rack.

2. Description of the prior art.

Lifting devices with a plurality of support points that are movable in relation to one another are well known in the art. One such device is disclosed by F. Aldinger in U.S. Pat. No. 1,675,015 which discloses a platform having a fixed jack at one end and a remotely raisable jack at the other end. The remote jack is movable horizontally in relation to the first jack. This permits remote positioning of the movable jack after placement of the fixed jack under the vehicle.

A patent to Brown, U.S. Pat. No. 3,405,781, discloses a pair of lifting apparatuses, each having two arms with slidable plates thereon. The slidable plates on one jack support a vehicle's front end and the slidable plates on the other jack support the rear end of the vehicle. As one jack raises one end, the sliding plates on the other jack move inwardly toward the first jack maintaining support of the vehicle. This permits one end of the vehicle to be lifted while the other end remains vertically stationary.

Other apparatus has been developed to assist in the inspection and repair of motor vehicle bodies that have received crash damage and require straightening. Generally, the straightening devices are attached to rolling platforms or devices similar to automotive lifts. The wheels are placed either on a fixed platform or on a movable platform that supports the wheels on a single axis in a fixed relationship to one another. When the body frame has been damaged, the wheels on a single axis may not be properly aligned with the body and will not fit properly in the wheel supports; thus, it will be difficult to properly load the vehicle upon the apparatus and properly align the center line of the vehicle on the center line of the apparatus.

Notwithstanding the existence of such prior art, it remains clear that there is a need for an apparatus that will accept the wheels of a damaged vehicle without regard to the misalignment of the axles and the body frame.

SUMMARY OF THE INVENTION

The present invention relates to an apparatus for adjustably positioning an automotive vehicle on an existing frame rack to align the vehicle with respect to the rack prior to and during repairs of the vehicle. The frame rack is of the type that has two substantially parallel and spaced apart longitudinal members, each member having a top surface, a first outboard facing edge and a second inboard facing edge.

The apparatus comprises four carriages that may be mounted on the frame rack for independent longitudinal movement over the top surface of the longitudinal members. Two of the four carriages are independently mounted on each of the longitudinal members. Each carriage comprises a chassis with a dolly mounted thereon for movement transverse to the longitudinal movement of the carriage. Each dolly is dimensioned and configured so that each dolly may receive a support point of the vehicle.

When loading a vehicle on the frame rack with the carriages mounted thereon, the two support points at one end of the vehicle are each mounted on a corresponding carriage, each carriage being mounted on a respective longitudinal member. The vehicle and carriages are moved forward on the rack until the support points at the other end of the vehicle can be placed on corresponding carriages. Any vehicle with damage that causes the support points to be out of alignment with the other support points may still be easily loaded on the rack due to the available longitudinal and transverse movement of the dolly in relation to the rack.

Movement of the vehicle in relation to the rack is easily accomplished, as the carriages move freely in relation to the rack. The vehicle is moved until the center line of the vehicle is aligned with the center line of the rack. The vehicle is then fixed in relation to the rack by any well known clamping means. Measuring the location of the dollies in relation to the carriage, in relation to the rack, and in relation to each other assists in the analysis of the damaged vehicle. The same measurements made during the straightening and repair process determines when the frame or unitized body misalignment has been corrected.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
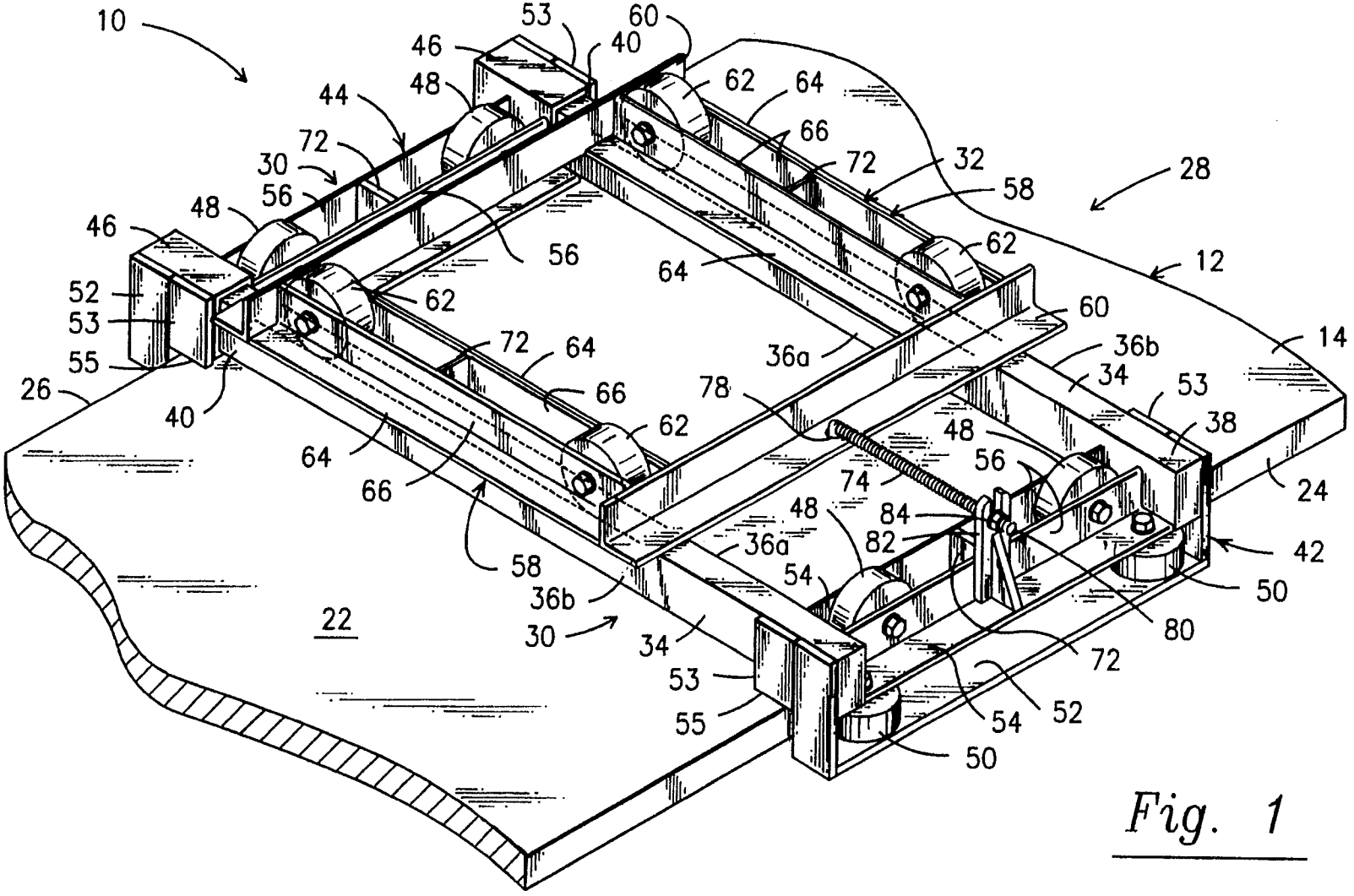
FIG. 1 is a perspective view of a preferred embodiment of the apparatus illustrating the apparatus mounted on a portion of a rack.
Figure 2:
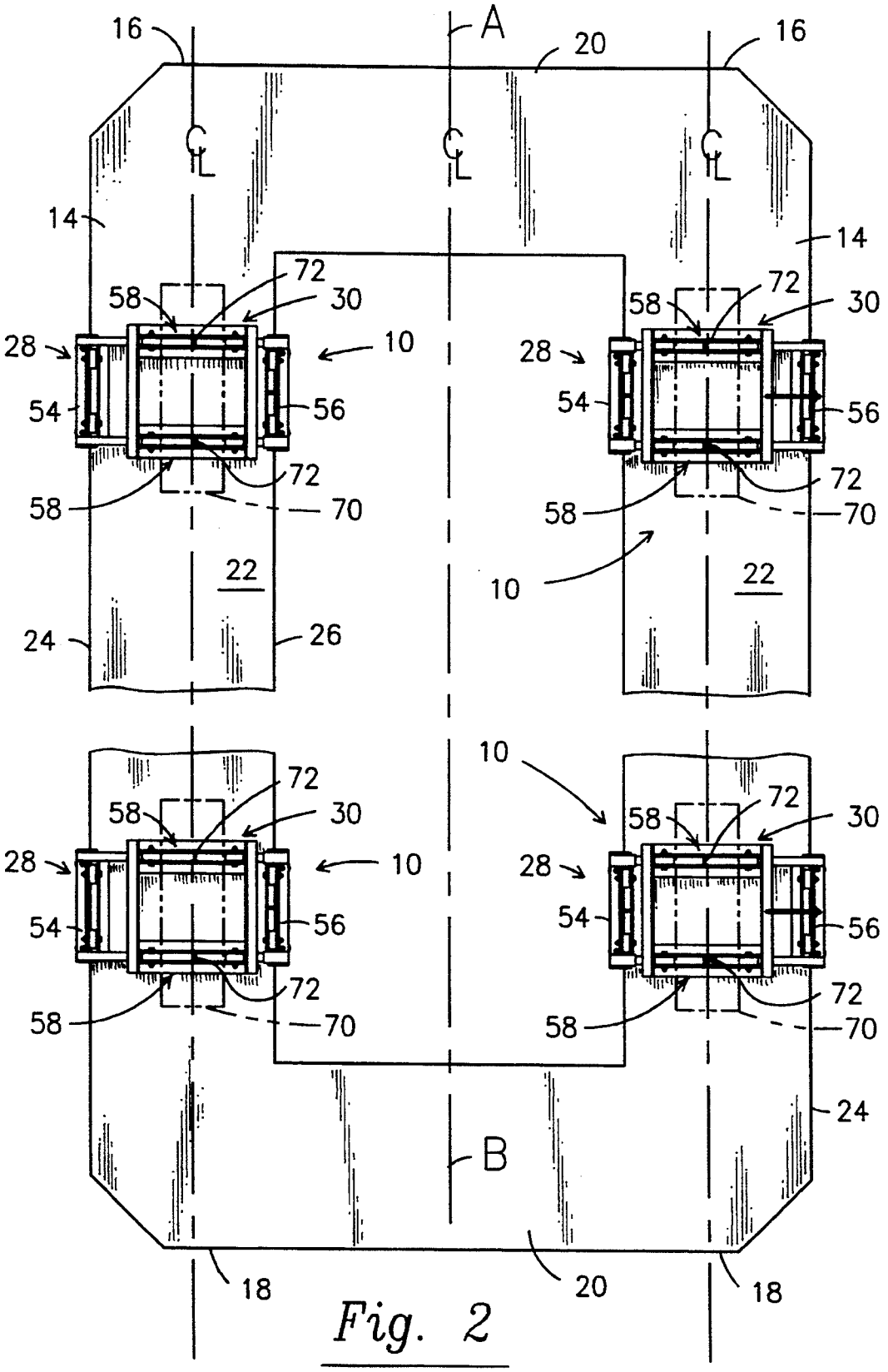
FIG. 2 is a plan view of four of the apparatuses of FIG. 1 illustrating four support points of a vehicle (shown in phantom) properly aligned on a rack.

A preferred embodiment for the apparatus for adjustably positioning an automotive vehicle on a frame rack is illustrated in FIG. 2 and is generally indicated as 10. A portion of a frame rack 12 is provided for illustrative purposes in FIGS. 1–4. The frame rack 12, most fully illustrated in FIG. 2, comprises two substantially parallel spaced apart longitudinal members 14, each having a first end 16 and a second end 18. The first ends 16 and the second ends 18 are joined by cross members 20. Each longitudinal member 14 comprises a top surface 22, a first outboard facing edge 24, and an inboard facing edge 26. In other embodiments, the frame rack 12 may have different configurations that are well known in the art, including but not limited to frame racks with longitudinal members that comprise a channel with upwardly extending legs for capturing the wheels of a vehicle. An embodiment of the apparatus 10 utilizing a frame rack with longitudinal members comprised of two channels would move longitudinally within the channels.

The apparatus is comprised of four carriages shown generally as 28. Each carriage 28 comprises a chassis, shown generally as 30, and a dolly, shown generally as 32, that is movably supported by the chassis 30. Each carriage 28 is mounted on the frame rack 12 for independent and longitudinal movement over the top surface 22. Two of the four carriages are mounted on each of the longitudinal members 14, as shown in FIG. 2.

As shown in FIG. 1, each chassis 30 is comprised of two spaced apart rails 34 that are substantially parallel to one another and aligned transverse to the longitudinal movement of the carriage 28 along the member 14. Each rail has two laterally facing sides **36*a* and 36*b*, and a first end 38 and a second end 40. The first ends 38 of rails 34 are connected to one another by a first guide bar, shown generally as 42, and the second ends 40 of the rails 34 are connected by a second guide bar, shown generally as 44. The first guide bar 42 is attached directly to the rails 34, while the second guide bar 44 comprises a pair of sleeves 46 which adjustably receive the second ends 40 of rails 34, permitting the rails 34 to be lengthened or shortened. Therefore, the chassis 30 may be adjusted to fit frame racks 12 having longitudinal members 14 of various widths. If desired, the second ends 40 of the rails 34 may be inserted within the sleeves 46, the excess removed, if necessary, and the sleeves 46 permanently attached to the rails 34** by welding, threaded fasteners or other well known means.

Each guide bar 42 comprises a top surface bearing means, conveniently a pair of support wheels 48, that movably engage the top surface 22 of the longitudinal members 14. The wheels 48 are spaced apart for stability and are aligned for longitudinal movement along longitudinal member 14. In other embodiments, the top surface bearing means may comprise rollers, slidable bearing plates, or any other suitable bearing means well known in the art.

In a preferred embodiment, each of the guide bars 42 and 44 further comprise an edge bearing means, conveniently guide wheels 50, that is supported by a U-shaped member 52 that is attached to each guide bar 42 and 44, projecting downwardly from the ends 38 and 40 of each rail 34, so that each guide wheel 50 may engage a respective outboard facing edging 24 or inboard facing edge 26 of the longitudinal member 14. The guide wheels 50 are spaced apart from one another and aligned for longitudinal movement along the longitudinal member 14. Again, the edge bearing means in other embodiments may comprise sliding plates, rollers or other bearing means that are well known in the art. Also, when the chassis 30 is used with a frame rack having U-shaped longitudinal members 14, the edge bearing means may be raised to engage the interior portion of the legs of the channel while the support wheels 48 engage the web of the channel.

An anti-tilt plate 53 is attached to each sleeve 46 on the second guide bar 44 and to each rail 34 adjacent to the U-shaped member 52 on the first guide bar 42. Each anti-tilt plate 53 projects downwardly so that the first end 55 is proximal to but spaced apart from the top surface 22 of the longitudinal member 14. If the vehicle is loaded improperly on a carriage 28, the anti-tilt plate 53 prevents the off-center load from tilting the carriage 28.

In a preferred embodiment, the guide bars 42 and 44 are constructed from steel angles 54 with the support wheels 48 mounted between the upwardly projecting legs 56 of each angle 54. The support wheels 48, in a preferred embodiment, are constructed of steel, but may be constructed from hard rubber or synthetic resins having the strength to withstand the loading.

Figure 3:
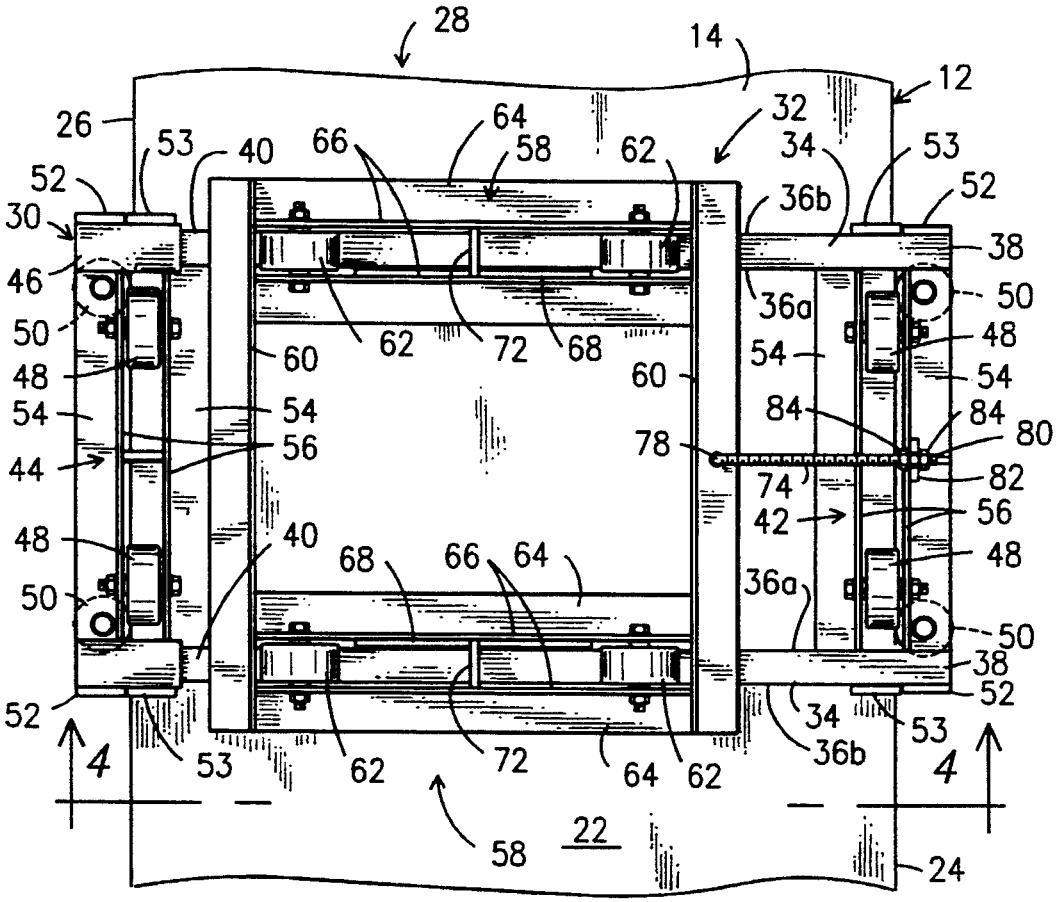
FIG. 3 is a plan view of the apparatus of FIG. 1.
Figure 4:
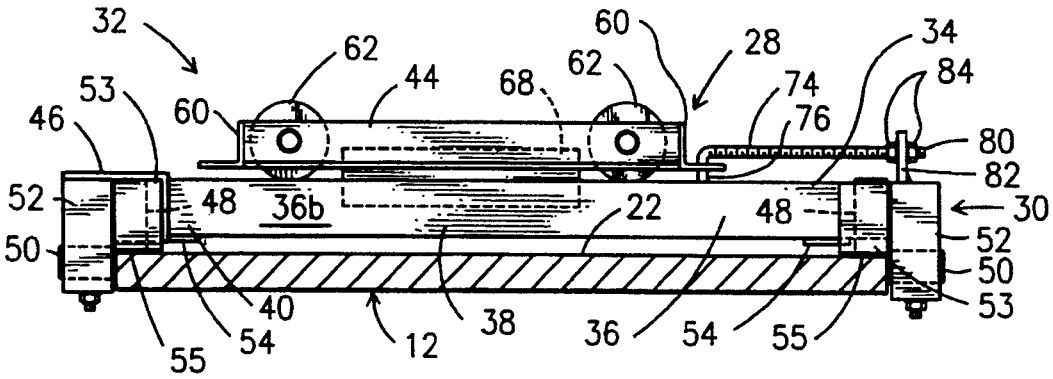
FIG. 4 is a side elevation view taken along line 4—4 of FIG. 3.

The dolly, shown generally as 32, is comprised of two support beams, shown generally as 58, that are aligned transverse to the longitudinal movement of the chassis 30. The support beams 58 are spaced apart and generally parallel to one another, being connected to one another by a pair of tie beams 60. In a preferred embodiment, a rail bearing means, conveniently a pair of rollers 62, is attached to each one of the support beams 58 so that each pair of rollers 62 engage a corresponding rail 34 for movement thereon transverse to the longitudinal movement of the chassis 30. The support beams 58 comprise a pair of angular elements 64 each having upwardly extending legs 66, between which are mounted the rollers 62. The support beams 58 are spaced apart so that each pair of rollers 62 may engage a respective rail 34. In order to prevent the dolly 32 from slipping off the chassis 30, a rub plate 68 is attached to each support beam 58 so that they extend downwardly therefrom and lie adjacent to non-corresponding laterally facing sides **36*a* or 36*b*, as best seen in FIGS. 3 and 4. In order to maintain the dolly 32 on the chassis 30, each rub plate 68 must lie adjacent an inwardly facing one of the sides 36*a*, or each rub plate must lie adjacent an outwardly facing one of the sides 36*b***.

Each carriage 28 comprises a vehicle support means, conveniently the support beams 58 of the dolly 32, which are sized and configured to receive a support point of a vehicle thereon. In a preferred embodiment, as seen in FIG. 2, wheels 70 of a vehicle are shown in phantom engaging the support beams 58. The support beams are sufficiently spaced apart to capture the curvature of the wheels 70. A centering indicator, conveniently strut 72, is mounted between the legs 66 of the angular elements 64 of the support beams 58 at a predetermined point. In a preferred embodiment, the struts 72 are located halfway between the tie beams 60, so that the wheels 70 may be centered between the tie beams 60 on the dolly 32. This is but a convenient way to provide additional support and strength to the dolly as well as a means for providing a centering indicator. Any other convenient means may be used to mark a center point, including painting, forming a groove in the support beams 58, adding a projection to the support beams 58, or any other well known and convenient means of identifying a particular location.

As best seen in FIGS. 3 and 4, a locking means, conveniently bar 74, may be used to lock the dolly 32 in a plurality of positions in relation to the rails 34. The bar 74 has a first end 76 that is formed generally in a right angle so that it extends downwardly through an aperture 78 in the tie beam 60. The second end of the bar 80 engages and rests in a U-shaped post 82. In a preferred embodiment, the bar 74 is threaded and a pair of nuts 84 lock the bar to the post 82 as can best be seen in FIG. 4. By moving the nuts 84 on the bar 74, the dolly 32 may be moved in the locked position to any point on the chassis intermediate the guide bars 42 and 44. In other embodiments, the locking means may comprise a means for locking the wheels, clamping the dolly 32 to a rail 34 or other means well known in the art.

With the locking bar 74 disengaged, the rub plates 68, by extending downwardly, as shown in FIG. 4, engage the guide bars 42 and 44 at either ends of the chassis 30 when the dolly 32 is moved from one end 38 of the rails to the other end 40. The engagement of the rub plates 68 with the guide bars 42 and 44 prevent the dolly 32 from disengaging from the chassis 30.

Having thus set forth a preferred construction for the apparatus 10 of this invention, it is to be remembered that this is but a preferred embodiment. Attention is now invited to a description of the use of the apparatus 10.

The four carriages 28 are each mounted on a frame rack 12, each chassis 30 being adjusted to fit the width of the corresponding longitudinal member 14. The rails 34 may be bolted to the sleeves 46 or welded if a permanent installation is desirable. Each chassis 30 is fitted snugly on its longitudinal member 14 so that there is little free movement between the guide wheels 50 and the outboard facing edge 24 or the inboard facing edge 26; yet, the carriage 28 is permitted to move freely on its longitudinal member 14.

The support points of the automotive vehicle, conveniently wheels 70, are mounted on respective carriages 28. One set of wheels 70 that are on the same vehicle axis are mounted in the dollies 30 of a respective pair of carriages 28 that are each mounted on a respective one of the longitudinal members 14. The carriages 28 are easily moved along the frame rack 12. When the second pair of wheels 70 are adjacent the frame rack, that axle is lifted and each wheel is placed in a respective one of a second pair of carriages 28. A center mark is made upon each wheel 70 and that center mark is aligned with the centering indicator strut 72, while the wheels 70 are being placed in the carriages 28. The vehicle may now be freely moved longitudinally along the members 14. With the locking bar 74 disengaged, the vehicle may also be moved transversely to the direction of movement along the longitudinal members 14 as the dollies 32 move along the rails 34 of the corresponding chassis 30. The center line B of the vehicle is determined and aligned with the center line A of the frame rack 12, as shown in FIG. 2. A locking-adjustment bar 74 is then engaged on not more than one carriage 28 for each axle of the vehicle. To assist in precisely centering the vehicle, the nuts 84 on the locking-adjustment bar 74 may be advanced a little at a time so that the dolly 32 is slowly moved along the rails 34 and the center line B of the vehicle becomes precisely aligned with the center line A of the frame rack 12. When the precise alignment is attained, the nuts 84 are tightened to the post 82 locking the dolly 32 to the carriage 28. The frame or unitized body of the vehicle is then fixed in relation to frame rack 12, by clamping means well known in the art. The apparatus 10 may be used with vehicles having a frame or unitized body system. Clamping procedures are much simpler for vehicles having a unitized body as clamping points are provided on most vehicles. Vehicles having frames may have to be chained in position to fix them in relation to the frame rack 12. Measurements may now be taken between each dolly 32, between each dolly 32 and the corresponding chassis 30, and between each dolly 30 and a predetermined point on the frame rack to determine which measurements are no longer to the factory standard for that vehicle (not shown). This determines the portions of the vehicle that must be straightened in order to complete the repairs. The apparatus 10 now serves as a gauge block during the repair of the vehicle. The locking-adjustment bar 74 is disengaged from each carriage 28. Forces are applied to the frame or to the unitized body to bring them into alignment. The wheels 70 move freely over the frame rack 12 providing little resistance to the pulling forces. After each correction is made, measurements can be easily retaken to determine what additional straightening is required. For example, a measurement may be taken between a specific point on the dolly 32 and the first end 38 of the rail 34. To determine if the alignment of the vehicle has been corrected, the same measurement may be taken between the dolly 32, supporting the other wheel 70 on the same axle and the end 38 of the rail 34 of the corresponding chassis 30. When properly aligned, the values of the measurements will be equal. Once the vehicle has been straightened, it may be removed from the apparatus 10 and the frame rack 12.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for adjustably positioning an automotive vehicle on a frame rack used for repair of the frame of the vehicle, the vehicle having a plurality of automotive wheels, and the frame rack having two substantially parallel, spaced apart longitudinal members, each of said members including a top surface, a first outboard facing edge and a second inboard facing edge, said apparatus comprising:

four carriages, each mounted for independent longitudinal movement over the top surface of the longitudinal members; two of said four carriages so mounted on each one of the longitudinal members of the frame rack; and a dolly mounted on each said carriage for movement transverse to said longitudinal movement of said carriage, each said dolly comprising two spaced apart support beams attached thereto that are aligned transverse to said longitudinal movement of said carriage, said support beams being joined by two spaced apart tie beams, said support beams and said tie beams being adapted to receive a portion of a corresponding one of the automotive wheels therebetween.

2. An apparatus as in claim 1 wherein each said dolly further comprises a centering indicator attached to at lest one said support beam, whereby an equator of each automotive wheel, the equator that is transverse to the axis of rotation of the automotive wheel, may be aligned with said centering indicator, thereby positioning the automotive wheel on said dolly in a centered position.

3. An apparatus as in claim 1 herein said carriage further comprises a chassis, said chassis comprising two spaced apart rails, each said rail having two laterally facing sides, said rails being substantially parallel to one another and aligned transverse to said longitudinal movement of said carriage, and two spaced apart guide bars joining said rials to one another, and wherein said dolly further comprises a pair of rub plates, each said rub plate being attached to a respective support beam and extending downwardly therefrom such that said rub plates lie adjacent to non-corresponding ones of said laterally facing sides of a respective said rail.

4. An apparatus as in claim 1 wherein said support means is adapted to receive the wheels with tires mounted thereon.

5. An apparatus for adjustably positioning an automotive vehicle on a frame rack used for repair of the frame of the vehicle, the vehicle having a plurality of automotive wheels, and the frame rack having two substantially parallel, spaced apart longitudinal members, each of said members including a top surface, a first outboard facing edge and second inboard facing edge, said apparatus comprising:

four carriages, each mounted for independent longitudinal movement over the top surface of the longitudinal members; two of said four carriages so mounted on each one of the longitudinal members of the frame rack; each said carriage comprising a chassis, said chassis comprising two spaced apart rails, each said rail having an inboard facing side, said rails being substantially parallel to one another and aligned transverse to said longitudinal movement of said carriage, and two spaced apart guide bars joining said rails to one another; each said carriage of said four carriages further comprising a dolly mounted on said chassis and movable thereon transverse to the longitudinal movement of said carriage, said dolly comprising two support beams aligned transverse to said longitudinal movement of said carriage, said support beams being joined by two spaced apart tie beams, said dolly having a support means dimensioned and configured to receive one of the automotive which thereon; and each of said two carriages on one of said longitudinal members further comprising a locking-adjustment means comprising a bar having a first end attached to one of said tie beams of said dolly and a second end adjustably connected to one of said guide bars of said chassis, whereby said dolly may be locked in a plurality of positions in relation to said rails.

6. An apparatus for adjustably positioning an automotive vehicle on a frame rack used for repair of the frame of the vehicle, the vehicle having a plurality of automotive wheels, and the frame rack having two substantially parallel, spaced apart longitudinal members, each of said members including a top surface, a first outboard facing edge and second inboard facing edge, said apparatus comprising:

four carriages, each mounted for independent longitudinal movement over the top surface of the longitudinal members; two of said four carriages so mounted on each one of the longitudinal members of the frame rack, each of said four carriages further comprising:

a chassis, said chassis comprising two spaced apart rails aligned substantially parallel to one another and aligned transverse to said longitudinal movement of said carriage, and two spaced apart guide bars joining said rails to one another; and a dolly mounted on said chassis and movable thereon transverse to the longitudinal movement of said carriage, each said dolly comprising two support beams aligned transverse to said longitudinal movement of said carriage, two spaced apart tie beams joining said support beams to one another, and a rail bearing means attached to each said support beam, each said rail bearing means engaging a corresponding said rail for movement thereon, each said dolly dimensioned and configured to receive one of the automotive wheels thereon.

7. An apparatus for adjustably positioning an automotive vehicle on a frame rack used for repair of the frame of the vehicle, the vehicle having a plurality of automotive wheels, and the frame rack having two substantially parallel, spaced apart longitudinal members, each of said members including a top surface, a first outboard facing edge and second inboard facing edge, said apparatus comprising:

four carriages, each mounted for independent longitudinal movement over the top surface of the longitudinal members; two of said four carriages so mounted on each one of the longitudinal members of the frame rack, each of said four carriages further comprising;

a chassis, said chassis comprising two spaced apart rails aligned substantially parallel to one another and aligned transverse to said longitudinal movement of said carriage and two spaced apart guide bars joining said rails to one another, a pair of spaced apart support wheels attached to each said guide bar such that said support wheels movably engage said top surface of one adjacent said longitudinal member, a pair of spaced apart guide wheels attached to each said guide are such that said guide wheels engage a corresponding edge of said one longitudinal member; and a support means dimensioned and configured to receive one of the automotive wheels thereon.

8. An apparatus as in claim 7 wherein each said rail bearing means comprises a pair of spaced apart rollers aligned for movement on adjacent said rails.

9. An apparatus for adjustably positioning an automotive vehicle on a frame rack used for repair of the frame of the vehicle, the vehicle having a plurality of support points, and the frame rack having two substantially parallel, spaced apart longitudinal members, each of said members including a top surface, a first outboard facing edge and second inboard facing edge, said apparatus comprising:

four carriages, each carriage of said four carriages having a pair of spaced apart support wheels mounted thereon adapted for independent longitudinal movement over the top surface of one of the longitudinal members of the frame rack with two of said four carriages so mounted on each one of the longitudinal members of the frame rack; each one of said four carriages further comprising:

two spaced apart rails attached thereto, said rails being substantially parallel to one another and aligned transverse to said longitudinal movement of said carriage; and a dolly comprising a pair of spaced apart rollers engaging a corresponding said rail for movement thereon, said dolly dimensioned and configured to receive one of the support points of the vehicle thereon.

10. An apparatus as in claim 9 wherein each said carriage further comprises two pair of spaced apart guide wheels attached thereon, such that each pair of guide wheels engages a corresponding edge of one of the longitudinal members.

11. An apparatus as in claim 9 for adjustably positioning a vehicle whose support points include automotive wheels, wherein each said dolly is sized and configured to receive a corresponding one of the automotive wheels thereon.

12. An apparatus as in claim 11 wherein said support means is adapted to receive the wheels with tires mounted thereon.

* * * * *

UNITED STATES PATENT AND TRADEMARK OFFICE

CERTIFICATE OF CORRECTION

PATENT NO. : 5,357,777

DATED : October 25, 1994

INVENTOR(S) : Sam Castellano

It is certified that error appears in the above-identified patent and that said Letters Patent is hereby corrected as shown below:

Column 7, claim 3, line 1, delete "herein" and insert therefore --wherein--

Column 8, claim 7, line 36, delete "," and insert therefore --;--

Signed and Sealed this

Third Day of January, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,357,777

DATED : October 25, 1994

INVENTOR(S) : Sam Castellano

It is certified that error appears in the above-identified patent and that said Letters Patent is hereby corrected as shown below:

Column 7, line 10, delete "rials" and insert therefore --rails--

Column 7, claim 7, line 46, delete "which" and insert therefore --wheel--

Signed and Sealed this

Twenty-eight Day of February, 1995

Bruce Lehman

*Attest:*

BRUCE LEHMAN

*Attesting Officer*

*Commissioner of Patents and Trademarks*